United States Patent [19]

Shull

[11] 4,037,686

[45] July 26, 1977

[54] ESCAPE LADDER

[76] Inventor: Harold H. Shull, 6745 Florida Drive, Lantana, Fla. 33462

[21] Appl. No.: 691,992

[22] Filed: Feb. 6, 1976

[51] Int. Cl.[2] ..... E06C 1/383; E06C 9/08

[52] U.S. Cl. ..... 182/96; 182/97; 182/160

[58] Field of Search ..... 182/96, 160, 159, 95, 182/97

[56] References Cited

U.S. PATENT DOCUMENTS

| | | | |
|---|---|---|---|
| 27,972 | 4/1860 | Deckelmann | 182/97 |
| 149,909 | 4/1874 | Barnard | 182/162 |
| 716,057 | 12/1902 | Labranche | 182/160 |
| 1,799,089 | 3/1931 | Clark | 182/160 |
| 3,024,864 | 3/1962 | Padlo | 182/160 |

*Primary Examiner*—Reinaldo P. Machado
*Attorney, Agent, or Firm*—Robert K. Youtie

[57] ABSTRACT

An escape ladder including a plurality of cross-pieces or rungs extending in parallelism between and pivotally connected to a pair of side pieces or rails for parallel movement of the latter between an open spaced operative ladder condition and a closed condition with the rungs concealed within the side pieces, at least one side piece being detachably pivotally mounted to a building for use therewith and removal therefrom.

6 Claims, 7 Drawing Figures

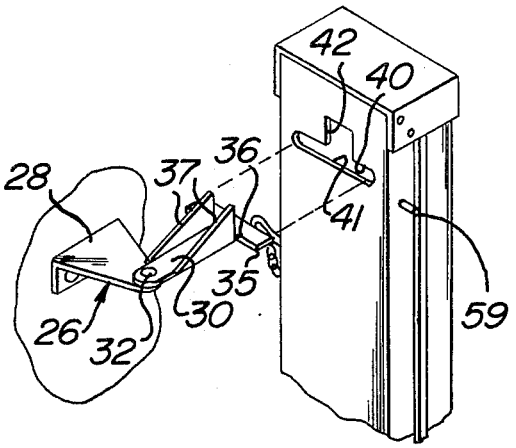
FIG. 4
FIG. 6
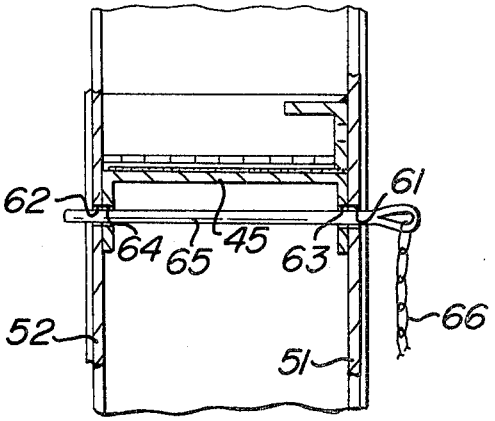
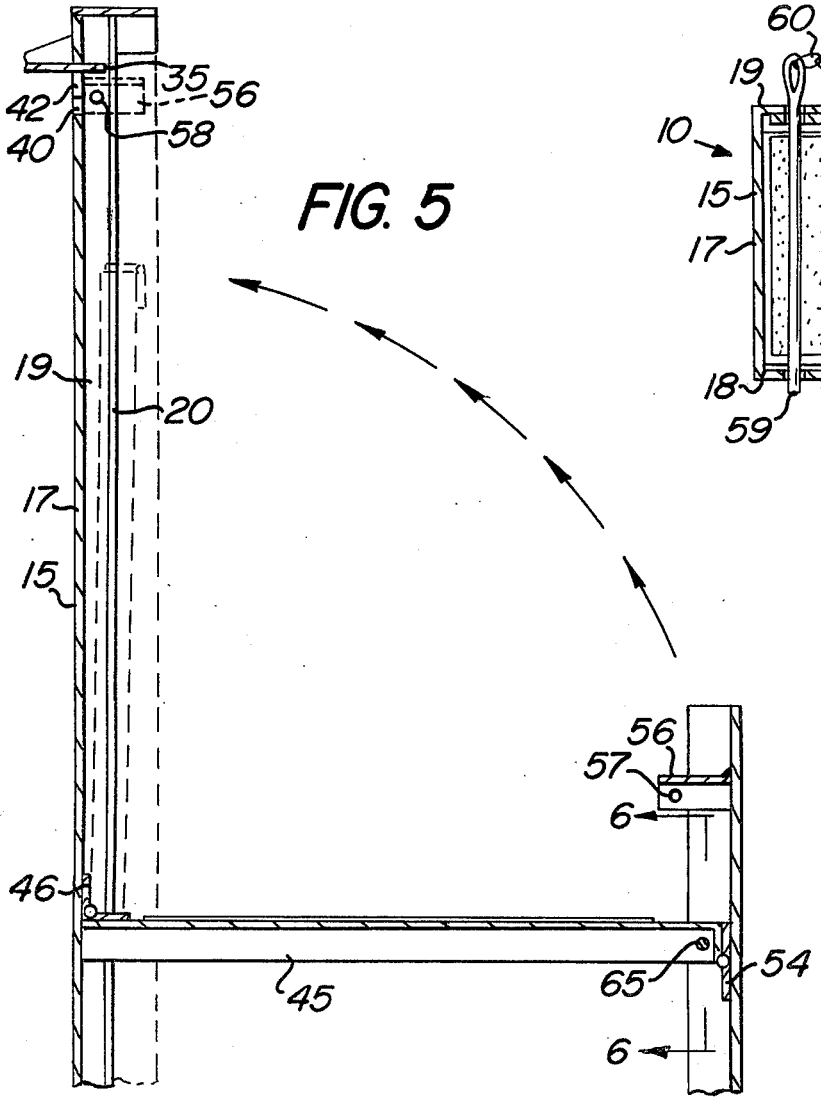
FIG. 5
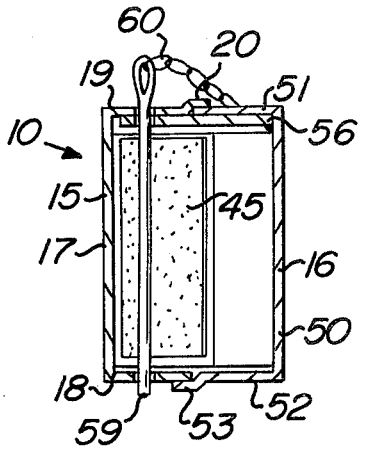
FIG. 7

ESCAPE LADDER

BACKGROUND OF THE INVENTION

As is well known to those versed in the art, a wide variety of escape ladders have been proposed, as for escaping fire and other hazards. However, such prior ladder constructions have not found popular acceptance for several reasons. For example, one type of prior escape ladder has involved a high degree of flexibility or collapsibility, so that its open or operative conditin lacks desirable firmness and staunchness, therefore requiring a high degree of physical coordination, strength, skill and daring, so as to lie beyond the capability of many persons. Another type of prior escape ladder was of sufficient rigidity and staunchness, but involved such great structure, labor and materials, as to lie beyond the economic capability of most builders and potential users, being effectively limited to utilization where required by law. The latter type has often been found objectionable by its appearance, as well as affording access to burglars and other unauthorized breaking and entering.

SUMMARY OF THE INVENTION

It is, therefore, an important object of the present invention to provide an escape ladder of the general type described which overcomes the above-mentioned difficulites, being possessed of sufficient rigidity and staunchness for use by persons of all but the most infirm, and which is adapted to be effectively concealed from view as an escape ladder so as to preclude its use for unauthorized purposes, while not distracting from the aesthetic appearance of a building and being adapted for manufacture, construction and erection at a reasonable cost.

It is still another object of the present invention to provide an escape ladder having the advantageous characterisitcs mentioned in the preceding paragraph which is uniquely concealed by presenting the appearance of a conventional downspout, having its interior effectively protected against entry of rain and the like, which may be quickly and easily converted from its aesthetically concealed non-use condition to an operative open condition at a selected angle relative to the building for quick and easy escape, and which can further be readily detached from the building for use as a conventional ladder of portable nature, as desired.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 4 is a partial perspective view showing the closed ladder position of FIG. 3 and illustrating separation or disassociation from the building wall.

FIG. 5 is a sectional elevation view taken generally along the line 5—5 of FIG. 2, showing the ladder in open, operative condition, and illustrating the closed position in phantom.

FIG. 6 is a partial sectional elevational view taken generally along the line 6—6 of FIG. 5.

FIG. 7 is a horizontal sectional view taken generally along the line 7—7 of FIG. 3.

DESCRIPTION OF THE PREFERRED EMBODIMENT

Figure 1:
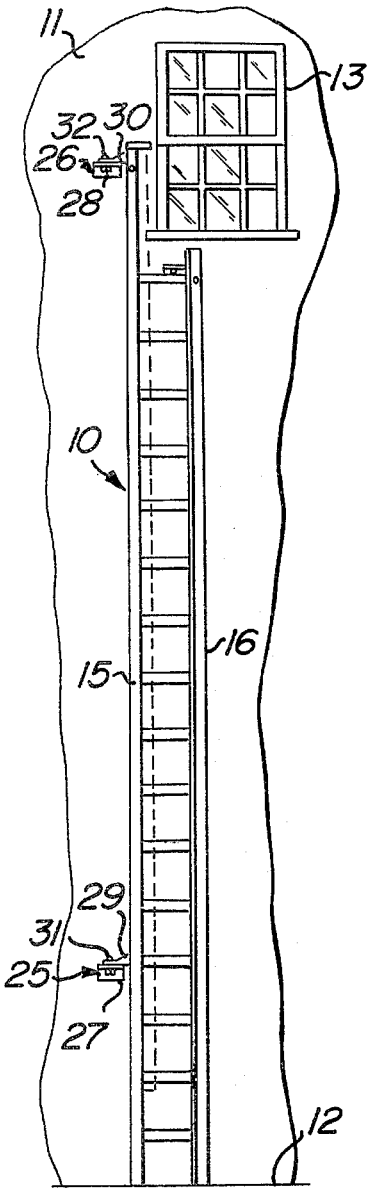
FIG. 1 is an elevational view showing a ladder of the present invention in operative association with a building wall, and illustrating its collapsed condition in outline.

Referring now more particularly to the drawings, and specifically to FIG. 1 thereof, a ladder of the present invention is there generally designated 10, and is illustrated in operative association with a building wall 11, upstanding from a ground surface 12. The building wall may include a window 13, and the ladder 10 located in adjacent relation with respect to the window for escape through the ladder, as will appear presently.

The ladder may include a pair of elongate channel-shaped side pieces or rails 15 and 16, which side pieces or rails may be of indentical cross-sectional configuration, if desired, say for economy in manufacture. The side piece or rail 15 may include a back wall or web 17, and a pair of generally parallel, laterally spaced side walls or flanges 18 and 19 outstanding from opposite sides edges of the web 17. Thus, the side piece 15 is generally U-shaped in cross-section, say being of extruded aluminum, or other suitable material, and may be provided on the edge of one side wall or flange, as along the edge of flange 19 with a longitudinally coextensive, outwardly offset lip 20, see FIG. 7.

Mounting means are provided at lower and upper locations, 25 and 26, on the wall 11 mounting the side piece or rail 15 for swinging movement about a vertical axis relative to the wall 11. More specifically, the mounting means 25 and 26, may each include a bracket, as at 27 and 28, fixedly secured to and outstanding from the wall 11, generally normal thereto, spaced vertically relative to each other. From the outer end of each bracket 27 and 28 extends an arm, 29 and 30, respectively, being pivotally connected, as at 31 and 32 to the adjacent bracket. More specifically, the arm 29 is pivotally connected by pin 31 in end-to-end relation with the outer end of bracket 27; and similarly, the arm 30 is pivotally connected by pin 32 in end-to-end relation with the outer end of bracket 28. Further, the pivotal axes or pins 31 and 32 are generally vertically aligned.

The mounting means 25 and 26 may each be substantially identical, so that it will suffice to illustrate only the latter in detail in FIGS. 4 and 5. It will there be seen that the arm 30 is provided at its outer end with a lateral enlargement, head or cross-piece 35, and immediately inwardly thereof a reduced portion or neck 36. Inward of the neck 36 the arm 30 is provided with a pair of upstanding ribs 37, defining stops or limits, as will appear more fully hereinafter.

Figure 2:
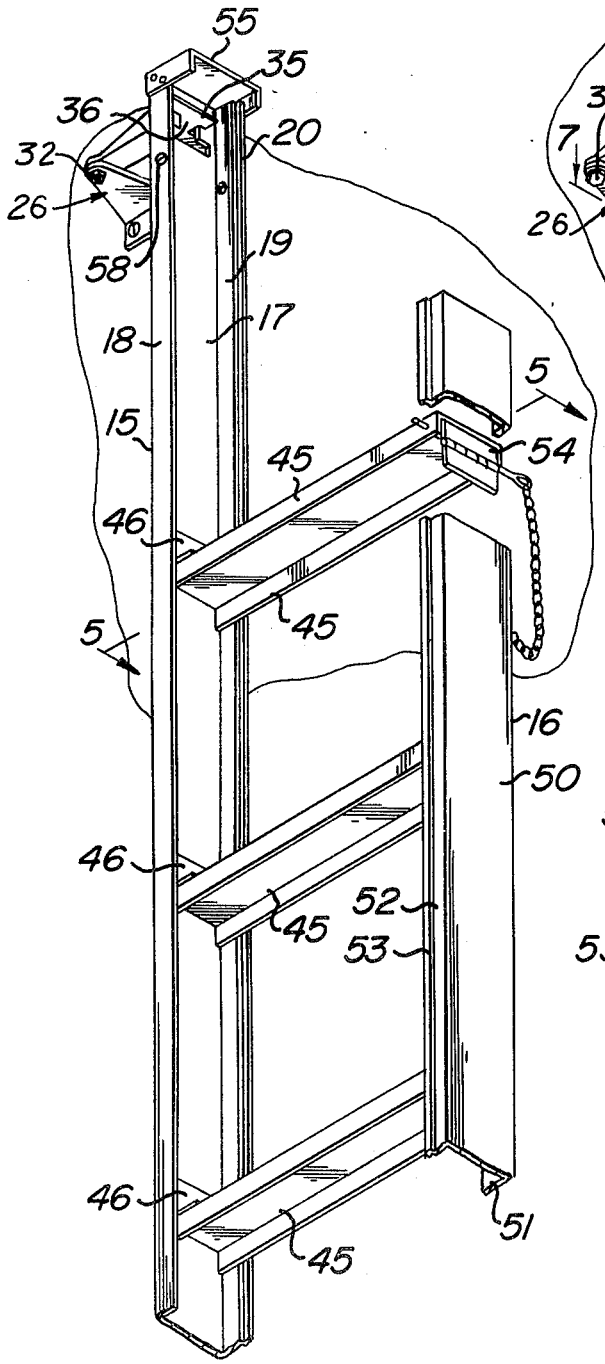
FIG. 2 is an enlarged partial perspective view, broken away for clarity of detail.

The side piece 15 is provided adjacent to each arm 29 and 30 with a specifically configured through opening, as at 40 adjacent to arm 30 best seen in FIG. 4. It will there be observed that the through opening 40 includes a laterally enlarged lower region 41 of slot-like configuration for conforming reception therethrough of end enlargement or head 35. The opening 40 further includes a reduced or narrowed upward extension 42 from a mid-region of the lower portion 41, the reduced portion 42 being sufficiently wide to receive the arm reduced portion or neck 36, as in the assembled condition of FIGS. 2 and 5. Thus, in assembly the arm head 35 is engaged through lower portion 41 until limited by abutting engagement of stops 37 with the outer side of channel 15, whereupon the channel may be shifted downward to engage the neck 36 in the reduced portion 42. Of course, the lower mounting means 25 may similarly and simultaneously engage in a lower opening of side piece wall 17 (not shown). Also, the side piece 15 may be separated or detached from the mounting means 25 and 26 by upward shifting movement of the side pieces to align the head 35 with slot 41 and withdrawal therefrom, mere reversal of the hereinbefore described procedure.

A plurality of cross-pieces, steps, or rungs 45 may be arranged in vertically spaced parallel relation with respect to each other, each having one end entering into the interior or hollow side of side piece 15, as between flanges 18 and 19, and there swingably connected to the ladder side piece by suitable pivot means, such as hinges 46. As in the illustrated embodiment, the cross-members, steps, or rungs 45 may also be of channel-like configuration, having their webs uppermost and their side flanges depending, in the operative condition of FIGS. 1 and 2. The pivotal connecting hinges 46 may assume other pivotal connection means, such as pins, pintles, gudgeons, or the like, any satisfactory pivotal connecting means being employed to swing the cross-members between their laterally outwardly projecting operative or open position and their closed or collapsed position lying at least partially within the hollow of the side piece 15.

The additional side piece 16 may be quite similar to the side piece 15, say being formed of identical extruded stock having a back wall or web 50, and side walls or flanges 51 and 52 extending in parallelism with each other from opposite side edges of the web. Along one edge of one side wall, say the edge of side wall 52, there may be provided an outwardly offset longitudinally extending lip 53, best seen in FIG. 7, diagonally opposite to the lip 20 of the first described side piece 15.

The side piece 16 receives the ends of cross-members 45 remote from the side piece 15, which cross-members have their received ends suitably pivotally connected within the hollow of channel-like side piece 16 by hinges 54 or other suitable pivotal connection means, such as pintless, pins, or the like. Thus, the several cross-members 45 are constrained to parallel movement with respect to each other, while the side pieces 15 and 16 are also constrained to parallel movement between the open solid line position of FIG. 1 and the closed position of FIG. 3.

Figure 3:
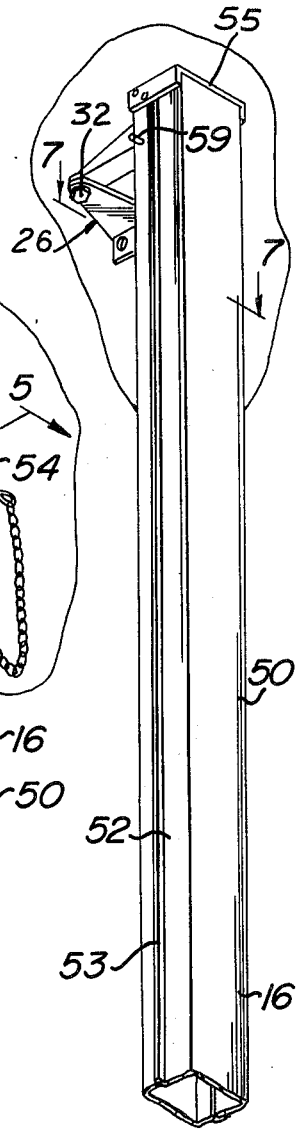
FIG. 3 is a partial perspective view showing the ladder of FIG. 2 in closed inoperative position.

It will be observed that the side piece 16 in the open position has its lower end resting on the ground 12, coterminus with the lower end of the side piece 15. However, the upper end of the side piece 16 terminates lower or short of the upper end of the side piece 15. While upon movement of the side piece 16 to its closed position toward the side piece 15, to enclose in the space therewithin the several cross-members 45, the upper end of the shorter side piece 16 is approximately coterminus with the upper end of the longer side piece. However, there is provided on the upper end of the longer side piece 15 a cover member, closure or cap 55, which may be fixedly secured in position extending across the upper end of the hollow of side piece 15, and beyond the hollow side thereof so as to extend over and close the upper end of the hollow of side piece 16 when the latter is in closed position, as seen in FIG. 3. The cap thus precludes entry of rain, dirt, and the like from interiorly of the region within the closed ladder 10.

In order to positively maintain the ladder 10 closed, there is provided on the shorter side piece 16, projecting laterally from the interior thereof an extension 56, as seen in FIG. 5, which projects toward and terminates short of the opposite side piece 15 when the ladder is open. The extension 56 is formed with a through aperture or hole 57. Upon movement of the side pieces 15 and 16 to their closed position, the extension 56 enters into the hollow of opposite side piece 15, as seen in phantom in FIG. 5. In alignment with the aperture 57 of the extension 56, the side piece 15 is provided with one or more through apertures 58 for removably receiving a through locking pin or bolt 59, as in FIG. 7, to positively retain the ladder closed. The bolt 59 may be suitably textured, as to 60, and quickly and easily removed by mere withdrawal to permit the ladder to open by gravity to the operative escape or utilization position. In order to lock the ladder in its position of use, the side piece 16 is provided with one or more apertures, as at 61 and 62, in respective side walls or flanges 51 and 52. One cross-member or step 45, say the uppermost, is provided with a pair of through apertures 63 and 64 located to align with aperture 61 and 62 when the ladder is open, for receiving a locking pin or bolt 65 to lock the ladder in its open position. The locking pin or bolt 65 is suitably tethered, as at 66, and may be selectively removed to permit return of the ladder to its closed position.

It will be noted, as in the closed ladder position of FIG. 5, that the extension 56 with its hole 57 and registering holes 58 of the side piece 15 are located such that a received pin 59 extends under the enlarged head 35 of arm 30. This prevents downward movement of the arm 30 and withdrawal of the head 35 from the opening 40 through the laterally enlarged lower portion 41. By this construction it will be appreciated that the ladder 10 may not be removed from its mounting means without removal of the pin 59, which effects opening of the ladder.

Although the present invention has been described in some detail by way of illustration and example for purposes of clarity of understanding, it is understood that certain changes and modifications may be made within the spirit of the invention.

What is claimed is

1. An excape ladder comprising a channel-shaped first side piece adapted to upstand along a building wall, mounting means on the exterior of said first side piece for mounting the latter to the building wall, a plurality of cross-pieces each having one end pivotally connected to the interior of said first side piece and extending in parallelism with each other from said first side piece, a channel-shaped second side piece in paralled facing relation with said first side piece, the other ends of said cross-pieces being pivotally connected to the interior of said second side piece to connect said first and second pieces together for parallel movement between a closed position in facing engagement with said cross-pieces enclosed within said side pieces and an open position with said side pieces spaced and said cross-pieces extending laterally between said side pieces, said mounting means comprising upper and lower arms extending laterally from the exterior of said first side piece for pivotal connection to the building wall, for swinging said ladder about a generally vertical axis toward and away from the wall, and detachable connection means connecting each of said arms to said first side piece for removably mounting the ladder to the wall, said detachable connection means each comprising a lateral end enlargement on the respective arm, said arms each having a reduced neck just inward of the end enlargement, and said first side piece having a relatively large through opening for receiving each of said enlargements, and a reduced upwardly extending opening for receiving the adjacent neck.

2. An escape ladder according to claim 1, in combination with a top cap on one of said side pieces to cover the region within said side pieces when the latter are closed, and a lip on one flange of each side piece movable into overlapping relation with the adjacent flange of the other side piece when said side pieces are closed.

3. An escape ladder according to claim 1, in combination with an extension on said second side piece and movable therewith into said first side piece when said side pieces are closed, and bolt means removably extending through said first side piece and extension to retain said side pieces closed, said removable bolt means extending through said first side piece in position to obstruct removal of the ladder from said detachable connection means, whereby removal of said bolt to open the ladder is prerequisite to removing the ladder from the wall.

4. An escape ladder comprising a channel-shaped first side piece adapted to upstand along a building wall, mounting means on the exterior of said first side piece for mounting the latter to the building wall, a plurality of cross-pieces each having one end pivotally connected to the interior of said first side piece and extending in parallelism with each other from said first side piece, a channel-shaped second side piece in parallel facing relation with said first side piece, the other ends of said cross-pieces being pivotally connected to the interior of said second piece to connect said first and second side pieces together for parallel movement between a closed position in facing engagement with said cross-pieces enclosed within said side pieces and an open position with said side pieces spaced and said cross-pieces extending laterally between said side pieces, said mounting means comprising upper and lower arms extending laterally from the exterior of said first side piece for pivotal connection to the building wall, for swinging said ladder about a generally vertical axis toward and away from the wall, said second side piece and one of said cross-pieces having apertures located to align when said ladder is open, pin means removably insertable through said aligned apertures to lock the ladder open, an extension on said second side piece and movable therewith into said first side piece when said side pieces are closed, and bolt means removably extending through said first side piece and extension to retain said side pieces closed, said removable bolt means extending through said first side piece in position to obstruct removal of the latter from said detachable connection means, whereby removal of said bolt to open the ladder is prerequisite to removing the ladder from the wall.

5. An escape ladder according to claim 4, in combination with detachable connection means connecting each of said arms to said first side piece for removable mounting the latter to the wall, said detachable connection means each comprising a lateral end enlargement on the respective arm, said arms each having a reduced neck just inward of the end enlargement, and said first side piece having a relatively large through opening for receiving each of said enlargements, and a reduced upwardly extending opening for receiving the adjacent neck.

6. An escape ladder according to claim 4, in combination with a top cap on one of said side pieces to cover the region within said side pieces to cover the region within said side pieces when the latter are closed, and a lip on one flange of each side piece movable into overlapping relation with the adjacent flange of the other side piece when said side pieces are closed.

* * * * *